US007762396B1

(12) United States Patent
Yang et al.

(10) Patent No.: US 7,762,396 B1
(45) Date of Patent: Jul. 27, 2010

(54) CUP CARRIER

(75) Inventors: Keegan Yang, Winslow, ME (US); Donald V. Breton, Vassalboro, ME (US); Robert K. Hussey, Waterville, ME (US)

(73) Assignee: Huhtamaki, Inc., Desoto, KS (US)

( * ) Notice: Subject to any disclaimer, the term of this patent is extended or adjusted under 35 U.S.C. 154(b) by 0 days.

(21) Appl. No.: 12/466,211

(22) Filed: May 14, 2009

(51) Int. Cl.
*B65D 1/36* (2006.01)

(52) U.S. Cl. ..... 206/427; 206/564; 229/407

(58) Field of Classification Search ..... 206/427, 206/557, 562, 563, 564, 486; 229/406, 407, 229/904
See application file for complete search history.

(56) References Cited

U.S. PATENT DOCUMENTS

| | | | | | |
|---|---|---|---|---|---|
| 1,757,689 | A | * | 5/1930 | Strickland | 206/562 |
| 3,295,737 | A | * | 1/1967 | Page et al. | 229/406 |
| 3,955,672 | A | * | 5/1976 | Brundage | 206/562 |
| 4,208,006 | A | | 6/1980 | Bixler et al. | |
| 4,218,008 | A | | 8/1980 | Vielleux | |
| D302,122 | S | | 7/1989 | Ashby | |
| D309,258 | S | | 7/1990 | Vigue | |
| D319,579 | S | | 9/1991 | Vigue | |
| 5,096,065 | A | | 3/1992 | Vigue | |
| D331,008 | S | | 11/1992 | Vigue | |
| 5,713,619 | A | * | 2/1998 | DuBois et al. | 294/159 |
| 5,915,561 | A | * | 6/1999 | Lorenzana et al. | 206/562 |
| 6,036,020 | A | * | 3/2000 | Distler | 206/564 |
| 6,076,876 | A | | 6/2000 | Letourneau et al. | |
| D438,100 | S | | 2/2001 | Cekota | |
| 6,398,056 | B1 | | 6/2002 | Letourneau et al. | |
| 6,651,836 | B1 | * | 11/2003 | Hofheins et al. | 220/575 |
| 6,679,380 | B2 | | 1/2004 | Brown | |
| 7,185,763 | B2 | * | 3/2007 | Ali | 206/561 |
| 7,225,927 | B2 | | 6/2007 | Sweeney | |

FOREIGN PATENT DOCUMENTS

| | | | |
|---|---|---|---|
| EP | 1489014 | A1 | 12/2004 |
| WO | 98/10687 | A1 | 3/1998 |
| WO | 2006/065132 | A2 | 6/2006 |

* cited by examiner

*Primary Examiner*—Jacob K Ackun, Jr.
(74) *Attorney, Agent, or Firm*—Husch Blackwell Sanders LLP

(57) ABSTRACT

A cup carrier for holding beverage cups within a range of shapes and sizes is provided. The carrier has a cup-holding socket that has stabilizing shoulders and stabilizing walls extending inwardly and downwardly therefrom. The stabilizing walls include an upper portion having a relatively shallow angle and lower portions having a steeper angle. This extends the stabilizing wall further into an upper region of the socket, thereby enabling the stabilizing wall to contact smaller diameter cups at a higher point in order to increase stability. The upper portion contacts larger cups inserted into the socket. Because the upper portion initially has a relatively shallow angle, it exerts a desirable gripping force on the cups when it is deflected outwardly by the cup's sidewall. The carrier also includes a stepped center cavity for increased strength and rigidity.

24 Claims, 6 Drawing Sheets

CUP CARRIER

CROSS-REFERENCE TO RELATED APPLICATIONS

None.

BACKGROUND OF THE INVENTION

Carrying trays for holding and carrying beverage cups are well-known and in widespread use throughout fast-food restaurants, stadiums, convenience stores, coffee shops and the like.

Typically, the trays are comprised of a main body portion provided with a number of cup-holding sockets. The number of cup-holding sockets can vary, depending on the style of the carrying tray. Multiple designs exist, each having different shapes and sizes of cup-holding sockets with varying degrees of accommodation for beverage cups of different shapes and sizes.

Over time the demands on these carrying trays have evolved. The fast-food restaurant industry has continued to increase maximum portion sizes, including the use of very large beverage cups for soft drinks. One type of beverage cup that has become very popular has a "step-walled" structure where the bottom portion of the cup is smaller in diameter than the top portion of the cup. These "step-walled" cups are designed to hold large amounts of beverage while maintaining a base small enough to fit into reasonably-sized cup holders, such as those present in automobiles or the arm rests of stadium seats. These cups often have the capacity to hold 32 or even 44 ounces of liquid. However, the design of these cups only provides a carrying tray with a smaller gripping area towards the bottom, while raising the height of the liquid load, thus making the cups top-heavy.

More recently, many restaurants have introduced and heavily marketed high-end coffee and tea beverages, which are typically served in smaller, narrower cups than traditional soda cups. These cups may only hold 10 or even less ounces of liquid.

These combined trends have created broader requirements on the range of cup sizes that must be accommodated by a cup carrier.

Manufacturers have attempted to accommodate the variety of large and small cup sizes in several ways. The most common method is to provide flexible members on the sides of the cup-holding sockets that deflect as the cup is inserted, in an attempt to accommodate a range of cup base sizes. Examples of this approach are shown in U.S. Pat. Nos. 4,208,006 to Bixler, 4,218,008 to Vellieux, and 6,398,056 to Letourneau. The problem with this approach has been that, due to the downward sloping walls, the contact point with the cup is related to the cup base size. Therefore, cups with smaller base sizes are gripped at very low points, thereby decreasing stability.

Another method to address this problem has been to increase the depth of the cup-holding sockets. A deeper socket can provide some tipping resistance to a small cup, even if it is not gripped securely. Some examples of this approach are illustrated in U.S. Pat. Nos. D438,100 to Cekota, and 7,225,927 to Sweeney. A drawback of this approach is that it necessitates a taller structure, preventing the design from being run on certain molding machines. Another disadvantage of this approach is that it increases the developed area of a carrier. If the product is made to the same weight as a shorter carrier, the weight per unit area must be lower, thereby weakening the structure. If the weight is increased to compensate, this results in higher material, energy, and transportation costs and increases the amount of natural resources used. Another disadvantage of this approach results because bundles of these carriers create taller stacks, thereby requiring an increase in storage space and shipping costs.

A third method has been to replace the angled sidewall members with short, flexible tabs. Some examples of this approach are illustrated in U.S. Pat. Nos. 6,679,380 to Brown and 6,651,836 to Hofheins. The longer the tabs, the wider a range of cup sizes can be contacted by them. However, the longer the tabs, the weaker their gripping force becomes. Also, the rigidity of the socket structure is weakened due to the lack of material near the base of the socket. Cup tipping tendency may be greater if the bottoms of the cups are not captured by the socket.

A fourth method has been to provide sockets of different sizes on the same cup carrier, as shown for example in U.S. Pat. Nos. D319,579 to Vigue, 5,096,065 to Vigue, and 6,679,380 to Brown. The problem with this approach is that the practicality of the cup carrier is significantly decreased. Such a cup carrier is restricted to a limited number of combinations of large and small cups. The cup carriers disclosed in these references have four cup carrying sockets—two of which can only carry large cups and two of which can only carry small cups.

In addition to problems with cup fit discussed above, cup carriers also have been called upon to support heavier weights, due to the use of larger sized cups. Cup carriers that have been overloaded tend to buckle in a predictable manner, collapsing along a line between adjacent cup sockets, through or near the center of the tray. The area between the cup sockets is a weak point in a typical cup carrier. Some current designs have small, highly contoured areas in the center, which resist buckling, but provide little stabilization to the surrounding structure. Other designs have a wide, flat center pocket, which gives greater support to the surrounding structure, but can be easily buckled by direct application of force.

Accordingly, a need exists for a cup carrier capable of carrying beverage cups within a wide range of sizes, including large cups, "step-walled" cups, and small cups, in a secure and stable manner. A need also exists for a cup carrier capable of carrying several filled cups at a time without having the carrier collapse or buckle from the weight of the filled cups. A further need exists for a cup carrier that can be produced using pre-existing molding machines and is composed of less material.

SUMMARY OF THE INVENTION

The present invention involves the provision of a cup carrier formed of a resilient material having cup-holding sockets capable of holding and securing a variety of cups having different shapes and sizes. Each socket has stabilizing shoulders positioned in a spaced apart arrangement around the socket and a floor at the bottom of the socket on which a cup can rest. Extending inwardly and downwardly from each stabilizing shoulder are stabilizing walls. The stabilizing walls are composed of an upper lead-in portion and a lower portion. The upper portion has a downward slope that is shallower than that of the downward slope of the lower portion. Additionally, the length of the upper portion may be less than the length of the lower portion.

This socket configuration extends the stabilizing wall further into an upper region of the socket, thereby enabling the stabilizing wall to contact smaller diameter cups at a higher point. The higher contact point provides increased cup stability. Additionally, this socket configuration allows the stabilizing wall to be in contact with the cups from the uppermost contact point down to the stabilizing wall's lowermost edge, thereby providing a larger area of contact.

The socket configuration also allows the carrier to hold larger cups, such as "step-walled" cups. In one embodiment, both the upper and lower portions of the stabilizing wall are in contact with the larger cups. The fact that the shallow-angled upper portion is in contact with the larger cups is beneficial. Because the upper portion initially has a relatively shallow angle, it in turn exerts more gripping force against the cup when it is deflected outwardly by the cup's sidewall. This is especially advantageous in the case of "step-walled" cups because, as mentioned above, these types of cups only provide a small gripping area, while raising the height of the liquid load, thus making the filled cups top-heavy and more susceptible to tipping.

The carrier also includes structural features to increase strength and rigidity. For example, the carrier has a stepped center cavity or well. The center cavity comprises a stepped sidewall which resists buckling and provides increased rigidity.

Other and further objects of the invention, together with the features of novelty appurtenant thereto, will appear in the course of the following description.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
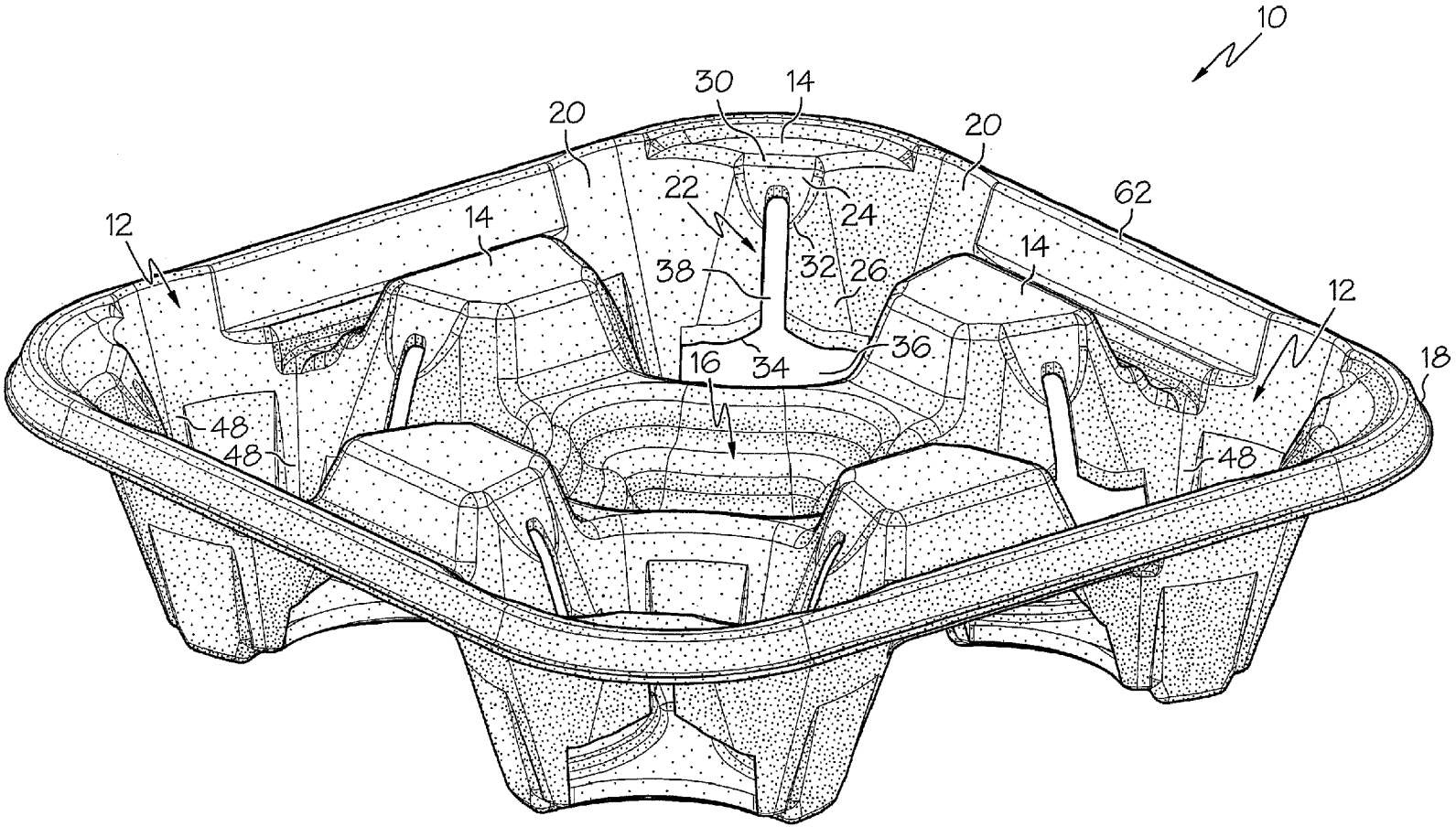
FIG. 1 is a side perspective view of a cup carrier in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

Reference numeral 10 designates generally a cup carrier 10 formed of a resilient material, such as molded fibrous pulp. The cup carrier 10 may be manufactured by molding fibrous pulp against molds or dies in a process and manner well-known in the art. In an alternative embodiment, the cup carrier 10 may be made from other materials, such as plastics, foams, or other materials having desirable strength and resiliency.

The cup carrier 10 has at least one cup-holding socket 12 molded therein to securely hold beverage cups of a variety of shapes and sizes. Such cups may be of a conventional style having a frustoconical sidewall with a circular cross-section and a bottom wall secured thereto. The cups may also include "step-walled" cups wherein the bottom portion of the cup is smaller in diameter than the top portion of the cup. The cups may have a flat bottom surface or a rimmed bottom surface and can be made from materials such as plastic, paperboard, foam, or the like. The cups may have a variety of capacities, for example, ranging from compact cups capable of holding only 4 ounces of liquid to very large "step-walled" cups capable of holding 44 ounces of liquid.

FIG. 1 shows a cup carrier 10 that includes four cup-holding sockets 12 of substantially the same size, one being provided in each corner of the carrier 10, with a center cavity 16 positioned therebetween. However, the carrier 10 can take on different configurations and numbers of sockets 12. Even though the illustrated carrier 10 includes four sockets 12, it will be understood that the number of sockets 12 may be varied to be less than or greater than four sockets 12. For example, in one embodiment, the carrier 10 includes one or two sockets 12 with the remainder of the carrier 10 comprising a substantially flat food carrying surface. The carrier 10 can also include a downturned continuous peripheral rim or flange 18 having a top surface 62.

Figure 2:
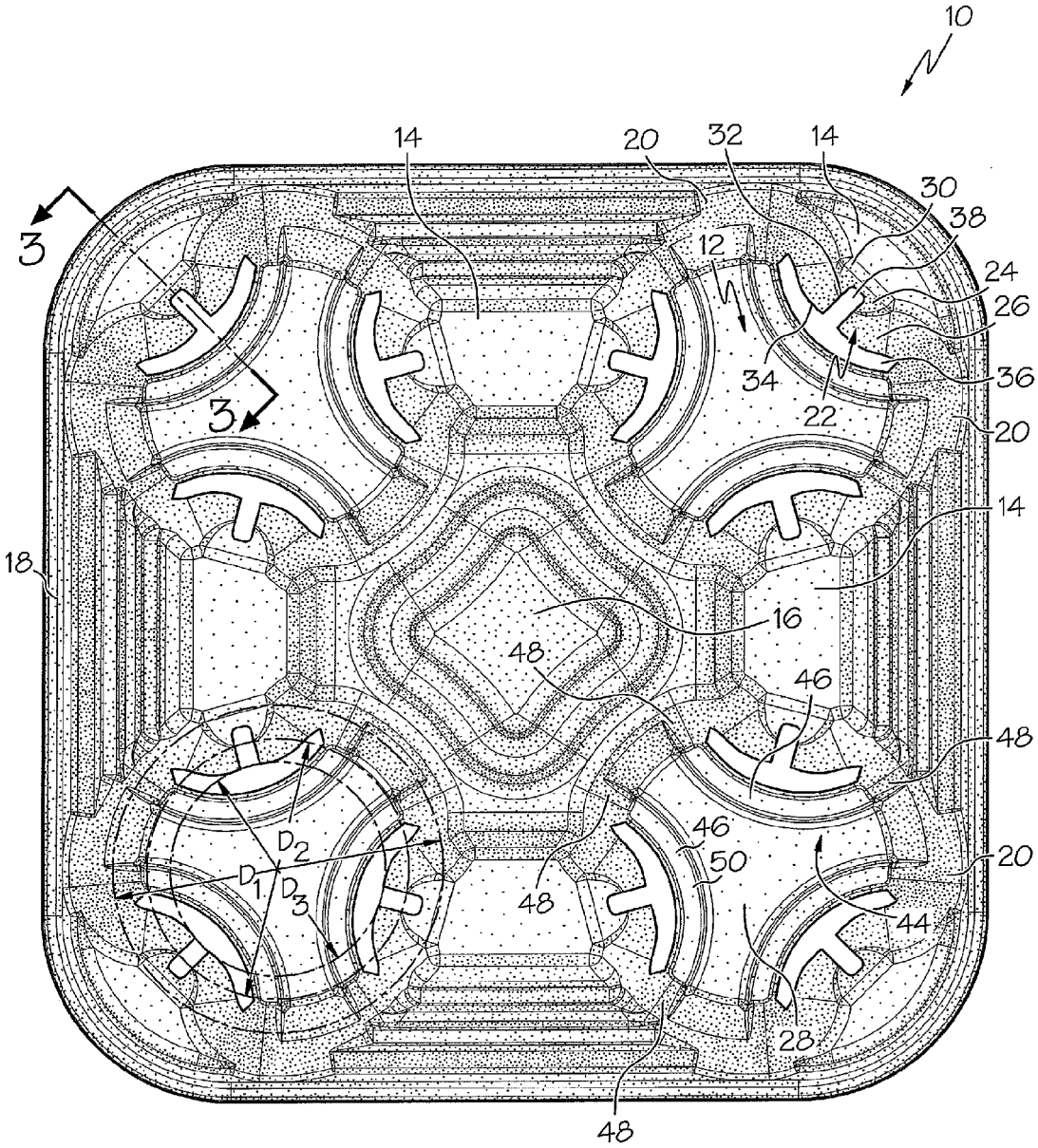
FIG. 2 is a top side view of a cup carrier in accordance with one embodiment of the present invention.

Each cup-holding socket 12 comprises at least two stabilizing shoulders 14 positioned in a spaced apart arrangement around the socket 12. The stabilizing shoulders 14 may be positioned at a level substantially equal to the top surface 62 of the rim 18, as depicted in FIG. 1, or may be positioned at a level above or below the top surface 62 of the rim 18. As illustrated in FIGS. 1 and 2, there are three stabilizing shoulders 14 spaced substantially equidistantly around each cup-holding socket 12. As discussed in further detail below, the inner edges 30 of the three stabilizing walls 22 (which are shown in the Figures as rounded structures) define the size of the socket 12 opening, and thus the diameter of the widest cup that may be received within the socket 12. As shown in FIG. 1, the inner edges 30 of the three stabilizing walls 22 also act as the upper edges of the stabilizing walls 22.

Each socket 12 is provided with a floor 28. The socket floor 28 is integrally molded with sidewall portions 20 that are located around socket 12 between the stabilizing shoulders 14. The socket floor 28 optionally has reinforcing ribs 44 associated therewith. The reinforcing ribs 44 are slightly raised above the socket floor 28, normally to a distance between 1/16-1/4 of an inch. In the embodiment illustrated in FIG. 2, there are three reinforcing ribs 44 associated with each socket floor 28.

Figure 3:
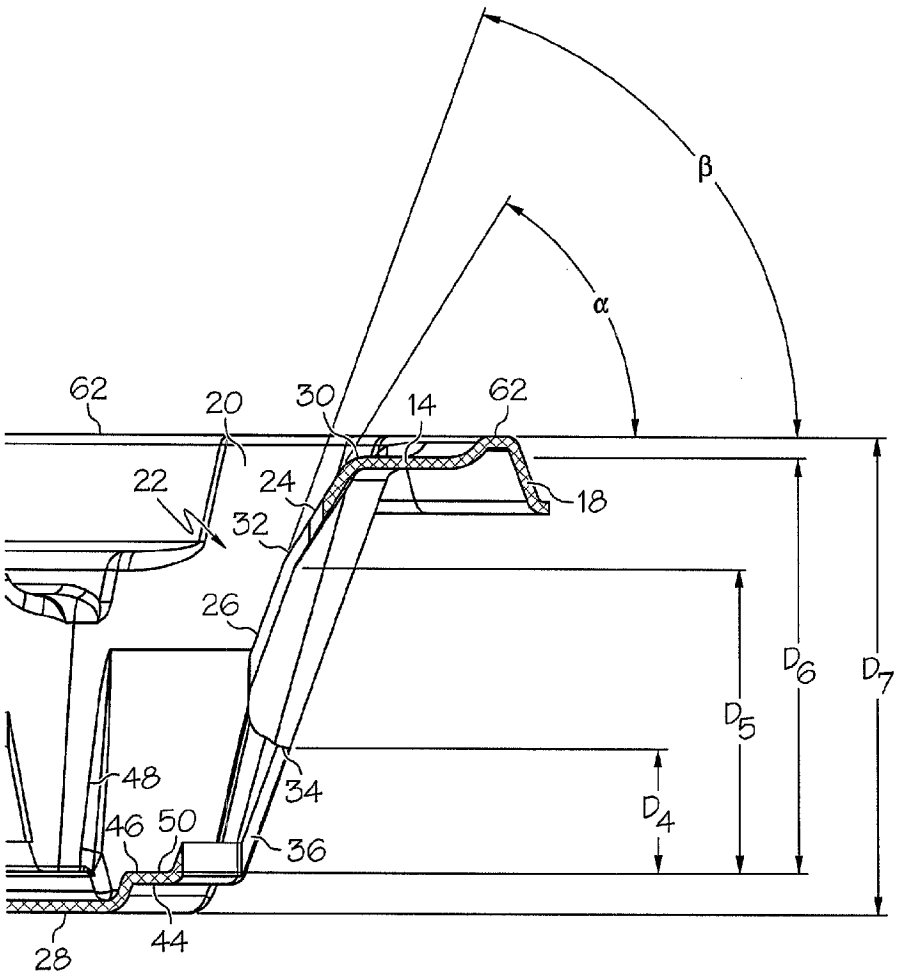
FIG. 3 is a fragmentary cross-sectional view of a socket portion of the cup carrier shown in FIG. 2 taken generally along line 3-3*n* the direction of the arrows.

In one embodiment, the reinforcing ribs 44 comprise horizontal portions 46 associated with the socket floor 28 and generally vertical portions 48 connected therewith that extend at least partially up the sidewalls 20, as best shown in FIGS. 2 and 3. This configuration provides the socket 12 with additional rigidity and strength.

The bottom of a cup inserted into the cup-holding socket 12 normally, though not always, will rest on a cup-contacting surface. The cup-contacting surface can either be the top surface of the floor 28, or if reinforcing ribs 44 are present, then the top surface 50 of the reinforcing ribs 44. If the cup-contacting surface is the top surface of the socket floor 28, then the bottom of the cup will rest directly on the socket floor 28. When the top surface 50 of the reinforcing ribs 44 is the cup-contacting surface, then the bottom of the cup is slightly elevated above the socket floor 28. In the embodiments shown in FIGS. 4 and 5, the cup-contacting surfaces are the top surfaces 50 of the reinforcing ribs 44.

Extending downwardly and inwardly from each stabilizing shoulder 14 is a stabilizing wall 22 that continues to a distance above the socket floor 28. Each stabilizing wall 22 has an upper lead-in portion 24 and a lower portion 26, as will be discussed in further detail below. Alternatively, the upper and lower portions 24 and 26 of the stabilizing wall 22 can be understood as being two independent stabilizing walls, thereby providing an upper stabilizing wall and a lower stabilizing wall.

Each stabilizing wall 22 may optionally include a slot 38 which vertically bisects the wall 22. The slot 38 may extend upward from an opening 36, which is defined between the lower edge 34 of the stabilizing wall 22 and the socket floor 28. The slot 38 may terminate at a point below the stabilizing shoulder 14.

The stabilizing walls 22 are deflected outwardly when a cup is inserted into the cup-holding socket 12. The deflection and yieldability of the stabilizing walls 22 can be controlled by, adjusting the thickness, density, nature of material, and/or angle of the walls 22. The material, such as molded pulp, should have a resiliency such that the deflected walls 22 exert a gripping force on the inserted cup, regardless of the cup size.

An important aspect of the invention is the configuration of the socket 12. In order to securely hold the cups placed within the sockets 12, the stabilizing walls 22 are designed to contact the cups (of varying sizes) at a point desirably high up on the side of the cups. The features of the sockets 12 can be described by reference to the angles, measurements and ratios of the socket 12 and stabilizing walls 22 located therein.

Turning attention to the configuration of the stabilizing wall 22, the upper portion 24 has a downward slope that is shallower than the downward slope of the lower portion 26. As best seen in FIGS. 1 and 3, the upper portions 24 extend downwardly and inwardly into the socket 12 from their respective stabilizing shoulders 14. The lower portions 26, which extend from the upper portions 24 at junctions 32, continue to extend downwardly and inwardly into the socket 12, though at an angle steeper than that of the upper portions 24.

The upper portions 24 may have an angle $\alpha$ that is between about 20° and 80° from horizontal, or alternatively between about 30° and 70° from horizontal. The angle $\alpha$ is shown in the figures, for exemplary purposes only, at about 58° from horizontal. The lower portion 26 may have an angle $\beta$ that is between about 30° and 90° from horizontal, or alternatively between about 50° and 80° from horizontal. The angle $\beta$ is shown in the figures, again for exemplary purposes only, at about 71° from horizontal. All of these angles are measured when the stabilizing walls 22 are in an "at rest" position with no cup placed within the socket 12. Of course, these angles will change when a cup is inserted into the socket 12. In order to effectively accommodate both large and small cups, angle $\beta$ will be greater than angle $\alpha$.

As shown in FIG. 1, the length of the lower portion 26 is greater than the length of the upper portion 24. However, it will be understood that the length of the lower portion 26 may be equal to or less than the length of the upper portion 24 in alternative embodiments.

Figure 4:
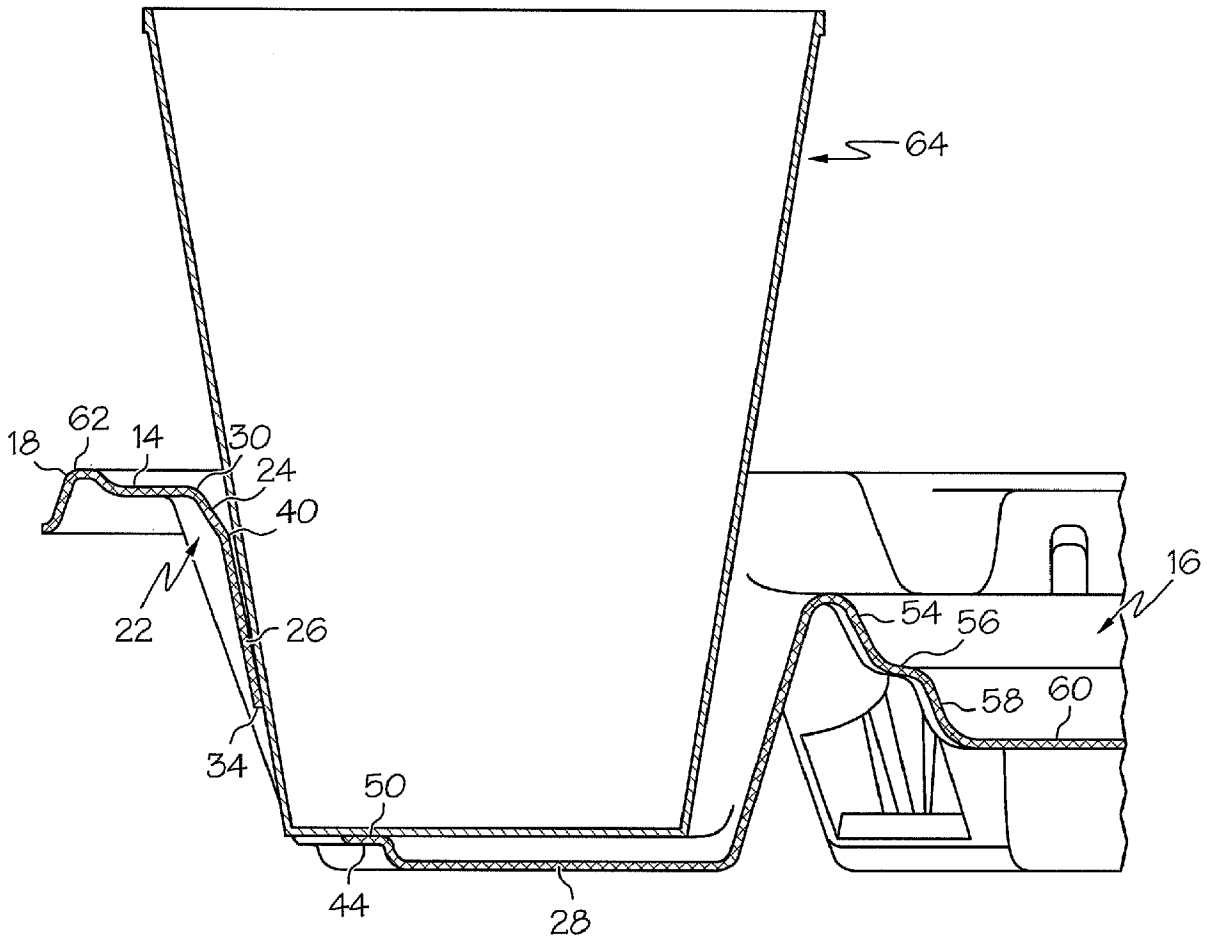
FIG. 4 is a fragmentary cross-section view of a cup carrier holding a smaller beverage cup in accordance with one embodiment of the present invention.

The configuration of the stabilizing walls 22 affords the socket 12 the ability to contact both small and large cups at a desired point on the slant or vertical height of the sides of the cups. This is demonstrated by comparing FIGS. 4-6. FIGS. 4 and 6 both show cup carriers holding smaller cups, similar to ones used to contain coffee. The prior art carrier shown in FIG. 6 has a stabilizing wall that extends downwardly and inwardly at a uniform angle, and therefore contacts the cup at a relatively low contact point.

However, the cup carrier 10 of the present invention shown in FIG. 4 has a stabilizing wall 22 that extends downwardly and inwardly at dual angles—first at a relatively shallow angle, then at a steeper angle. This design extends the stabilizing wall 22 further into a top portion of the socket 12, thereby enabling the stabilizing wall 22 to contact smaller diameter cups 64 at a relatively higher point 40, thereby providing increased stability. As can been seen, the contact point 40 for the cup 64 shown in FIG. 4 is proximate the junction 32 in the stabilizing wall 22. Additionally, the configuration allows the stabilizing wall 22 to be in contact with cup 64 from the contact point 40 down to the lower edge 34 to further increase stability. All the while, as illustrated in FIG. 5, the socket 12 has the ability to receive and secure larger cups, such as "step-walled" cups 66.

Figure 5:
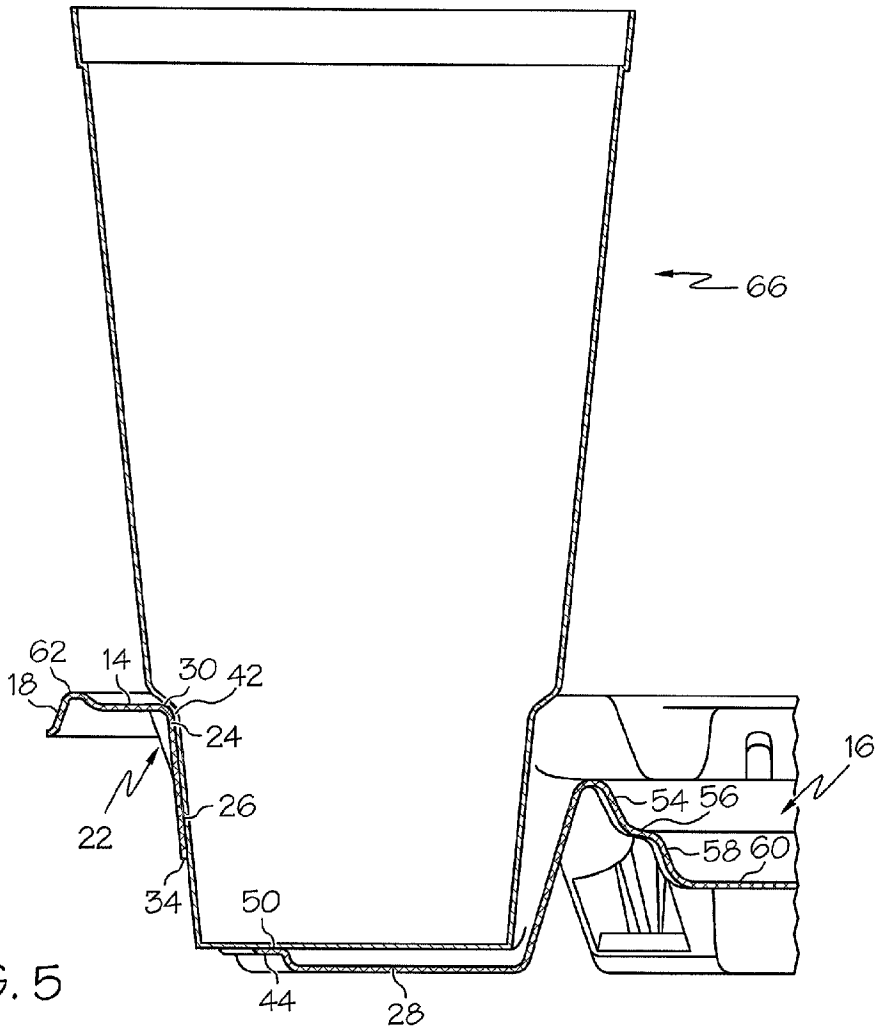
FIG. 5 is a fragmentary cross-section view of a cup carrier holding a "step-walled" beverage cup in accordance with one embodiment of the present invention.
Figure 6:
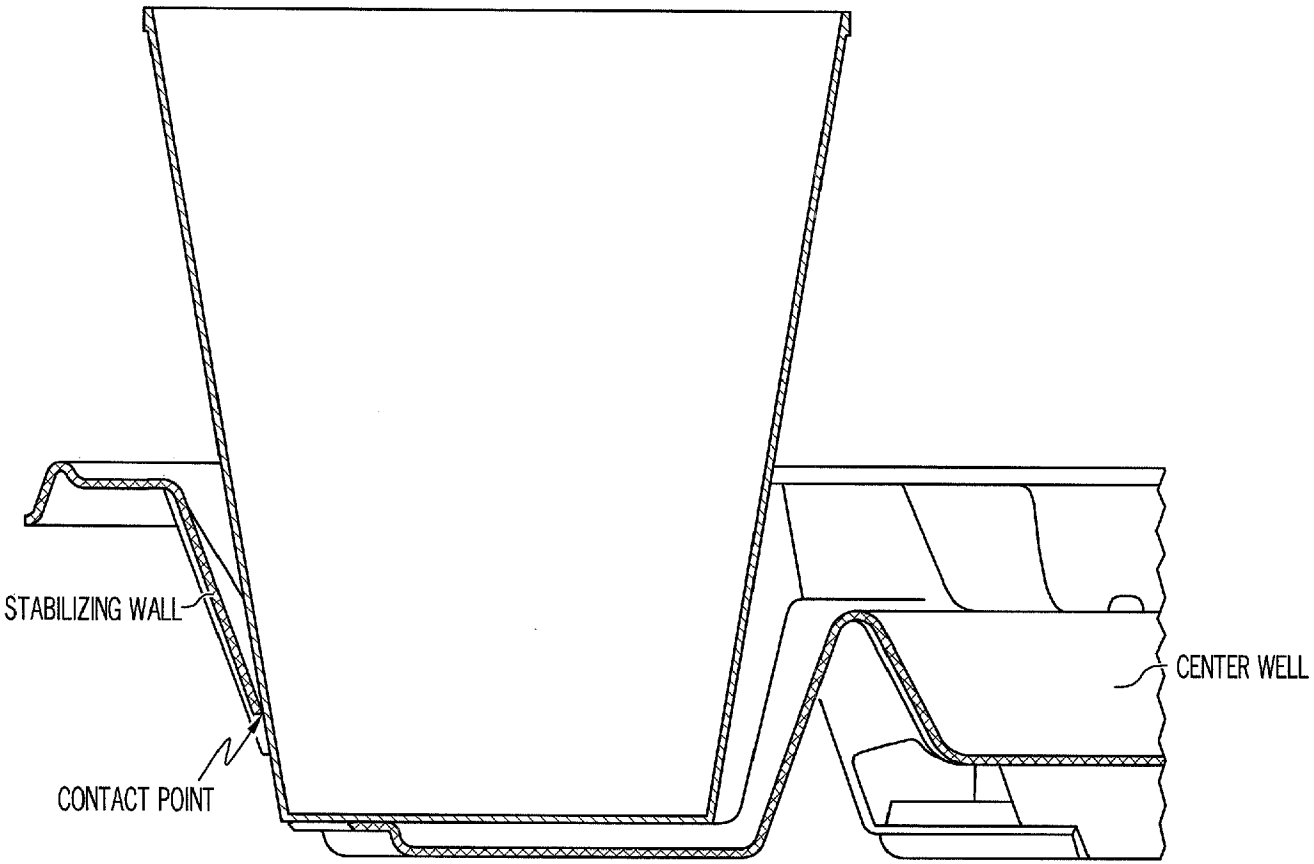
FIG. 6 (PRIOR ART)
FIG. 6 is a fragmentary cross-section view of a prior art cup carrier holding a smaller beverage cup.

As shown in FIG. 5, when a larger cup 66, such as a 32-ounce "step-walled" cup, is inserted into the socket 12, it is contacted by both the upper and lower portions 24 and 26 of the stabilizing wall 22 at a contact point 42. The stabilizing wall 22 is in contact with cup 66 from the contact point 42 down to the lower edge 34. Because the upper portion 24 initially has a relatively shallow angle, it exerts more gripping force on the cup 66 when it is deflected outwardly by the cup's sidewall. This is especially advantageous in the case of "step-walled" cups because, as mentioned above, these types of cups 66 only provide a small gripping area, while raising the height of the liquid load, thus making the cups 66 top-heavy and more susceptible to tipping.

The socket configurations can alternatively be defined, in part, by three independent diameters—the diameter $D_1$ at the upper edges 30 of the stabilizing walls 22, the diameter $D_2$ at the junctions 32 part way down the stabilizing walls 22, and the diameter $D_3$ at the lower edges 34 of the stabilizing walls 22 (see FIG. 2).

As mentioned above, the upper edges 30 of the three stabilizing walls 22 define the size of the socket 12 opening, and thus the diameter of the widest cup that the socket 12 can accommodate. As illustrated in FIG. 2, the diameter $D_1$ of a circle drawn tangent to the edges 30 defines the size of the socket 12 opening. Diameter $D_1$ may be between about 2 and 4 inches, or alternatively between about 2.5 and 3.5 inches. In one embodiment, diameter $D_1$ may be about 3 inches.

Another diameter $D_2$ is also formed by a circle drawn tangent to the intermediate junctions 32 defined by the locations where the upper and lower portions 24 and 26 of each stabilizing walls 22 converge. Diameter $D_2$ may be sized in order to conform to the diameter of a smaller cup 64 at the contact point 40. For example, diameter $D_2$ may be between about 1.5 and 3.5 inches, or alternatively between about 2 and 3 inches. In one embodiment, diameter $D_2$ may be about 2.5 inches.

A third diameter $D_3$ is formed by a circle drawn tangent to the lower edges 34 of the stabilizing walls 22. Diameter $D_3$ is equal to or smaller than diameter $D_2$ and may be between about 1 and 3 inches, or alternatively between about 1.5 and 2.5 inches. In one embodiment, diameter $D_3$ may be about 2 inches.

The socket configuration can be further defined by the ratio of the diameters $D_3$ and $D_1$ and diameters $D_2$ and $D_1$. For example, the ratio of diameter $D_3$ to diameter $D_1$ can be between about 0.5 and 0.8, and in one embodiment is about 0.67. Likewise, the ratio of diameter $D_2$ to diameter $D_1$ can be between about 0.7 and 0.9, and in one embodiment is about 0.83.

The socket configurations can be further defined by the distances and ratios between the cup-contacting surface, the lower edges 34 of the stabilizing walls 22, the intermediate junctions 32 of the stabilizing walls 22, and the upper edges 30 of the stabilizing walls 22. These distances are illustrated in FIG. 3. The distance $D_4$ between the cup-contacting surface and the lower edges 34 can be between about zero and 1 inch, and in one embodiment is about 0.5 inch. The distance $D_5$ between the cup-contacting surface and the intermediate junctions 32 can be between about 0.75 and 2 inches, and in one embodiment is about 1.3 inches. The distance $D_6$ between the cup-contacting surface and the upper edges 30 can be between about 1 and 3 inches, and in one embodiment is about 1.8 inches. The depth of the socket 12 remains such that the carrier 10 can be produced using pre-existing molding machines. The overall height $D_7$ of the carrier 10 can be, for example, about 2 inches. However, it will be understood that the height $D_7$ can certainly be more or less than that.

The ratio of distance $D_4$ to distance $D_6$ can be between about zero and 0.6, and in one embodiment is about 0.3. The ratio of distance $D_5$ to distance $D_6$ can be between about 0.4 and 0.9, and in one embodiment is about 0.7.

To compare the cup-holding ability of the new carrier 10 against that of existing cup carriers, which all have sidewalls with a unitary angle or slope, cups filled with a liquid were placed in the cup-holding sockets of the carriers. Each of the loaded carriers was then tilted until at least one of the cups became dislodged. The angle at which the cup became dislodged was measured and recorded. If no cups were dislodged by the time the carrier was tipped to 45°, then the test was stopped, and the result of 45° was recorded. Cup carriers V and W are products of Huhtamaki America, Cup carrier X is a product of Pactiv Corp., Cup carrier Y is a product of Cascade, and Cup carrier Z is a product of Greenwave. Each cup carrier was loaded with either four large cups or four small cups, depending upon the test.

In the case of the large cups, the carriers were loaded with four 32-ounce "step-walled" cups filled with liquid. This represents the maximum likely loading, where the carrier must support a full eight pounds of liquid. The results of these tipping tests are recorded below in Table A, under the column labeled "32-oz cups".

In the case of the small cups, the carriers were loaded with four 10-ounce highly tapered coffee cups filled with liquid. These cups were selected because they have the smallest base sizes in common use. The highly tapered sidewalls also increased the challenge, by making the cups top heavy. The results of these tipping tests are recorded below in Table A, under the column labeled "10-oz cups".

TABLE A

| Maximum Secure Tipping Angle | | |
|---|---|---|
| | 32-oz cups | 10-oz cups |
| Invention (New carrier) | 35° | 45° |
| Cup carrier V | 35° | 30° |
| Cup carrier W | 30° | 45° |
| Cup carrier X | 25° | 45° |
| Cup carrier Y | 20° | 45° |
| Cup carrier Z | 30° | 35° |

In general, when the performance of the existing carriers (Cup carriers V-Z) was good for a large cup, it was poor for a small cup, and vice versa. The performance of the new carrier 10 exceeded or equaled that of every other carrier, for both large and small cups. From these tests, it is seen that the new carrier 10 offers a significant improvement in the range of cup sizes that can be securely held without tipping.

As mentioned above, in some instances, the cup carrier 10 is used to carry four large cups 66 having capacities of 32 or more ounces. In such instances, carriers can be prone to buckling about their center sections. For example, the carriers undergo significant torsional stresses when loaded with full cups, especially when a user is attempting to hold the carrier with one hand. In such instances, material failures or buckling can occur about the carrier's center well or cavity.

In order to provide increased strength and rigidity, the carrier 10 has a uniquely designed center cavity 16. As best shown in FIGS. 1 and 4, the carrier's center cavity 16 has a stepped sidewall configuration. As illustrated, the cavity 16 includes a generally vertical upper sidewall 54, a generally horizontal intermediate wall 56, a generally vertical lower sidewall 58, and a bottom wall 60. This configuration provides a structure that resists buckling and increases rigidity.

To compare the strength and rigidity of the new carrier 10 against that of existing cup carriers, a deflection test was performed whereby the carriers were tested for their ability to support 32-ounce cups filled with liquid. During the test, one side of the carrier was clamped to a device in order to simulate being held by a hand. The two unsupported cup-holding sockets (i.e., those sockets furthest from the clamping device) were loaded with 32-ounce "step-walled" cups filled with liquid. The 32-ounce "step-walled" cups are considered to be highly demanding large cups, for the reasons already noted above. The carriers were left supporting the load for 30 seconds, effectively acting as cantilevered beams. If, during the 30 second time period, the carrier failed, the result was noted as "Failed" and no measurement was taken. However, if the load was supported the full 30 seconds, the tester measured the distance that the unsupported edge of the carrier had deflected down under the sustained load. Carriers with lower deflections were judged to be stronger. In cases where one type of carrier passed some, but not all, of the tests, the tester only measured the deflection when it passed. The results of these tests are recorded below in Table B.

TABLE B

| Rigidity Test | | |
|---|---|---|
| | % Fail | Deflection (mm) |
| Invention (New carrier) | 0 | 19 |
| Cup carrier V | 10% | 20 |
| Cup carrier W | 100% | N/A |
| Cup carrier X | 100% | N/A |
| Cup carrier Y | 20% | 24 |
| Cup carrier Z | 100% | N/A |

The data shows that the new carrier 10 had the lowest failure rate (it never failed), and the lowest deflection (19 mm) of all the cup carriers tested. The second strongest design indicated by the testing was Cup carrier V.

A computer simulation was constructed using Finite Element Analysis (FEA) to compare the structural integrity of the new carrier 10 against Cup carrier V. The FEA model simulated a force of 5 Newtons applied to the base of each cup-holding socket, while the tray was held fixed on one side. The simulated deflection predictions are shown below in Table C.

TABLE C

| FEA Computer Model Simulation Result | |
|---|---|
| | Deflection |
| Invention (New carrier) | 4.6 mm |
| Cup carrier V | 5.6 mm |

The computer model predicted that the new carrier 10 would have lower deflection (4.6 mm) than the Cup carrier V (5.6 mm). The testing and modeling work both support the contention that there was a significant improvement in the strength and rigidity of the new carrier's 10 structure.

Finally, testing was done to compare the weight of the new carrier 10 against the weights of existing carriers. Lighter weight carriers require less material and energy to manufacture, dry, ship, and dispose of. The carriers were weighed after conditioning for at least 24 hours in a standard atmosphere control laboratory. The average weights of the various styles of cup carriers described above are listed below in Table D.

TABLE D

| Tray Weight | Conditioned Weight (g) |
|---|---|
| Invention (New carrier) | 34.1 |
| Cup carrier V | 35.3 |
| Cup carrier W | 36.5 |
| Cup carrier X | 36.0 |
| Cup carrier Y | 34.3 |
| Cup carrier Z | 34.4 |

From this data, it is seen that the new carrier 10 is not only stronger, but is also lighter weight than existing carriers.

From the foregoing, it may be seen that the cup carrier of the present invention is particularly well suited for the proposed usages thereof. Furthermore, since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

What is claimed is:

1. A cup carrier of resilient material having at least one cup-holding socket to hold cups of different shapes and sizes, said cup-holding socket comprising:

at least two stabilizing shoulders positioned around the socket;

a cup-contacting surface upon which a cup can rest when inserted into the socket; and a stabilizing wall extending inwardly and downwardly from each of said stabilizing shoulders into the socket, each said stabilizing wall including an upper portion and a lower portion, wherein said upper portion has a downward slope that is shallower than a downward slope of said lower portion.

2. The cup carrier of claim 1 wherein the slope of said upper portion is shallower than the slope of said lower portion to provide a cup-contacting point located in an upper region of said socket.

3. The cup carrier of claim 1 wherein the slope of said upper portion is shallower than the slope of said lower portion to enable said upper portion to exert a desirable amount of gripping force against a large beverage cup.

4. The cup carrier of claim 1 wherein an angle of the slope of said upper portion is between 40 and 70 degrees from horizontal and an angle of the slope of said lower portion is between 50 and 80 degrees from horizontal.

5. The cup carrier of claim 1 wherein said stabilizing wall upper and lower portions each have a length, the length of said upper portion being less than the length of said lower portion.

6. The cup carrier of claim 5 wherein the length of said lower portion is greater than the length of said upper portion to provide a desirable amount of surface area contact between said stabilizing wall and said cup.

7. The cup carrier of claim 1 further comprising at least two cup-holding sockets with a downwardly extending stepped center cavity defined therebetween.

8. The cup carrier of claim 7 wherein said center cavity includes a stepped interior sidewall.

9. The cup carrier of claim 1 wherein the cup-holding socket has a floor and reinforcing ribs associated with said floor to support the bottom of a cup fully inserted into the socket.

10. The cup carrier of claim 9 wherein the cup-holding socket further comprises sidewalls located between said stabilizing walls and wherein said reinforcing ribs extend upward along at least a portion of said sidewalls.

11. The cup carrier of claim 1 wherein the cup-holding socket further comprises openings, each of said openings defined between a lower edge of each said stabilizing wall and said cup-contacting surface.

12. The cup carrier of claim 11 wherein each stabilizing wall defines a slot therethrough extending up from a respective opening and terminating at a point below the stabilizing shoulder.

13. The cup carrier of claim 12 wherein the slot extends up through said upper portion of each stabilizing wall.

14. The cup carrier of claim 1 wherein the carrier is formed at least partially of molded pulp.

15. The cup carrier of claim 1 wherein said carrier includes four sockets of substantially the same size with a stepped center cavity defined therebetween.

16. A molded cup carrier of resilient material for holding cups of different shapes and sizes, said cup carrier comprising:

at least two cup-holding sockets;

at least two stabilizing shoulders positioned around each said socket;

a floor within each said socket having a cup-contacting surface upon which a cup can rest when inserted into the socket;

an upper stabilizing wall extending inwardly and downwardly from each stabilizing shoulder into a respective socket;

a lower stabilizing wall extending inwardly and downwardly from each said upper stabilizing wall into a respective socket;

a downwardly extending center cavity defined between the sockets, said cavity including a stepped interior sidewall; and wherein the said upper stabilizing wall has a downward slope that is shallower than that of said lower stabilizing wall.

17. The cup carrier of claim 16 wherein an angle of the slope of said upper stabilizing wall is between 40 and 70 degrees from horizontal and an angle of the slope of said lower stabilizing wall is between 50 and 80 degrees from horizontal.

18. The cup carrier of claim 16 wherein said upper and lower stabilizing walls each have a length, the length of said upper stabilizing wall being less than the length of said lower stabilizing wall.

19. A cup carrier of resilient material having at least one cup-holding socket to hold cups of different shapes and sizes, said cup-holding socket comprising:

at least two stabilizing shoulders positioned around the socket;

a cup-contacting surface upon which a cup can rest when inserted into the socket; and a stabilizing wall extending inwardly and downwardly from each of said stabilizing shoulders into the socket, each said stabilizing wall including an upper, portion and a lower portion, wherein said upper portion has a downward slope that is shallower than a downward slope of said lower portion, and wherein said upper portion has a length that is less than a length of said lower portion.

20. The cup carrier of claim 19 further comprising at least two cup-holding sockets with a downwardly extending center well positioned therebetween, said center well having a stepped sidewall.

21. The cup carrier of claim 19 wherein each of said stabilizing walls has an upper edge, a lower edge and an intermediate junction defined by a location where the upper and lower portions of each stabilizing wall converge, and wherein the diameter $D_1$ of a circle drawn tangent to said upper edges is between about 2.5 and 3.5 inches, the diameter $D_2$ of a circle drawn tangent to said intermediate junctions is between about 2.0 and 3.0 inches, and the diameter $D_3$ of a circle drawn tangent to said lower edges is between about 1.5 and 2.5 inches.

22. The cup carrier of claim 21 wherein the ratio of diameter $D_3$ to diameter $D_1$ is about 0.67 and the ratio of diameter $D_2$ to diameter $D_1$ is about 0.83.

23. The cup carrier of claim 19 wherein each of said stabilizing walls has an upper edge, a lower edge and an intermediate junction defined by a location where the upper and lower portions of each stabilizing wall converge, and wherein the distance $D_6$ between said cup-contacting surface and said upper edges is about 1.8 inches, the distance $D_5$ between said cup-contacting surface and said intermediate junctions is about 1.3 inches and the distance between distance $D_4$ between said cup-contacting surface and said lower edges is about 0.5 inches.

24. The cup carrier of claim 19 wherein each of said stabilizing walls has an upper edge, a lower edge and an intermediate junction defined by a location where the upper and lower portions of each stabilizing wall converge, and wherein the ratio of the distance $D_4$ between said cup-contacting surface and said lower edges and the distance $D_6$ between said cup-contacting surface and said upper edges is about 0.3 and the ratio of the distance $D_5$ between said cup-contacting surface and said intermediate junctions and the distance $D_6$ is about 0.7.

* * * * *